US008875319B2

(12) United States Patent
Martin et al.

(10) Patent No.: US 8,875,319 B2
(45) Date of Patent: Nov. 4, 2014

(54) PROTECTIVE ELEMENT FOR USE IN SPORT

(75) Inventors: Philippe Martin, Chambly (CA); Pierre Paiement, St-Jerome (CA)

(73) Assignee: Sport Maska Inc., Montreal, Quebec ( * ) Notice: Subject to any disclaimer, the term of this patent is extended or adjusted under 35 U.S.C. 154(b) by 271 days.

(21) Appl. No.: 13/341,884

(22) Filed: Dec. 30, 2011

(65) Prior Publication Data

US 2013/0167291 A1 Jul. 4, 2013

(51) Int. Cl.
*A41D 27/26* (2006.01)

(52) U.S. Cl.
USPC ..... 2/459

(58) Field of Classification Search
CPC ..... A41D 13/00; A41D 13/06; A41D 13/08; A41D 27/26
USPC ..... 2/459, 267, 268, 455, 456, 16, 24
See application file for complete search history.

(56) References Cited

U.S. PATENT DOCUMENTS 4,467,475 A 8/1984 Gregory et al.
4,723,322 A * 2/1988 Shelby ..... 2/24
5,037,521 A 8/1991 Nishikawa et al.
5,168,576 A * 12/1992 Krent et al. ..... 2/456
5,423,087 A * 6/1995 Krent et al. ..... 2/463
6,122,768 A * 9/2000 McCrane ..... 2/16
6,553,579 B1 * 4/2003 Gillen et al. ..... 2/268
2005/0075046 A1 4/2005 Williams

FOREIGN PATENT DOCUMENTS

CA 2300774 A1 9/2001
CA 2422839 A1 9/2004
CA 2638231 A1 1/2009

OTHER PUBLICATIONS

Easton 06 Hockey catalogue.
Easton Stealth S9 Shoulder Pad Hang Tag; eastonhockey.com.

* cited by examiner

*Primary Examiner* — Khoa Huynh
*Assistant Examiner* — Anna Kinsaul
(74) *Attorney, Agent, or Firm* — Norton Rose Fulbright Canada

(57) ABSTRACT

A user wearable article of protective equipment for protecting a portion of a body of the user. The article of protective equipment generally conforms to the portion of the body of the user to be protected when worn by the user. The article of protective equipment includes: (i) an energy absorbent core, the core having a body-facing side and an opposing non-body-facing side, the core comprising a polymeric foam; and (ii) an outer shell generally covering the non-body-facing side of the core, the outer shell being deformable during the use of the article of protective equipment by the user.

23 Claims, 4 Drawing Sheets

PROTECTIVE ELEMENT FOR USE IN SPORT

FIELD

The present invention relates to protective equipment, particularly but not exclusively for use in sports.

BACKGROUND

Athletes participating in certain sports wherein impact is common, such as hockey, lacrosse, and football, wear protective equipment in order to reduce the chance that they will be injured during the course of play. In ice hockey for example, a player typically wears several different protective garments, such as an upper-body protector, elbow guards, and shin guards. Each one of these protective garments incorporates one or more articles of protective equipment. For example, upper body protectors typically incorporate chest protectors, back protectors and shoulder caps. Shin guards typically incorporate both shin protectors and knee caps. Elbow protectors typically incorporate elbow caps.

A design common to such conventional commercial protective equipment is a polymeric energy absorbent core covered by a rigid non-deformable polymeric outer shell.

Protective equipment of this design provides players with good protection from impact injuries. Nonetheless, manufacturers of such equipment regularly consider new protective equipment designs that might provide improve protection.

SUMMARY

It is an object of the present invention to provide protective equipment with a design that may provide good protection to certain players and/or in certain instances, in a sport such as ice hockey.

Thus, in one aspect, as embodied and broadly described herein, the present invention provides a user wearable article of protective equipment for protecting a portion of a body of the user. The article of protective equipment generally conforms to the portion of the body of the user to be protected when worn by the user. The article of protective equipment comprises an energy absorbent core. The core has a body-facing side and an opposing non-body-facing side. The core comprises a polymeric foam. The article of protective equipment also comprises an outer shell generally covering the non-body-facing side of the core. The outer shell is deformable during the use of the article of protective equipment by the user.

Without wishing to be bound by any particular theory, it is believed that protective equipment of the present design may provide better protection than current protective equipment of conventional designs for certain players of certain sports, particularly professional athletes such as professional ice hockey players. In particular it may be possible that because of the rigidity/non-deformability of the shells of protective equipment of conventional design, the force of an impact sustained by a player wearing such protective equipment is spread out across a much larger player body contact area than the actual area of the impact. This is because the shell does not substantially deform under such an impact and therefore the shell distributes the force of the impact across the shell's area of contact with the underlying core, which then distributes the force to the body of the player. Thus the player sustaining the impact effectively feels a smaller force over a larger area of their body (as compared with the same force over the smaller actual area of impact). For some, if not most, players, conventional protective equipment of this design provides them with good protection. However, for players at a very high or professional level of skill, the aforementioned force distribution effect may cause the player to believe that the player has sustained an impact of less force than they have, making them believe that they can sustain impacts of even greater force (be they with the boards or other players). Depending on the circumstances, this may not be desirable.

It is believed that by protective equipment of the present design being deformable (e.g. that flexes or distorts) in normal use when the player sustains an impact, that this will reduce the aforementioned phenomenon related to force distribution and will cause the player to effectively "feel" more of the force of the hit in the area in which they sustained the impact. This may allow the player to more accurately judge the force of the impacts they sustain, allowing them to more accurately control their actions and the effects of those actions during game play. In some embodiments, protective equipment of the present design will also reduce the aforementioned phenomenon by having an outer shell and an inner core that locally deform in the area that the player sustains an impact.

Non-limiting examples of polymeric foams of which the core may include are expanded polymer foams such as expanded polypropylene and expanded polyethylene. In some embodiments, the core is formed of expanded polymer foam that can repeatedly deform without breaking and/or permanently deforming.

In some embodiments, the core consists essentially of the polymeric foam. In the present context, this should be understood to mean that all of the material energy absorbing elements of the core are polymeric foam (whether a single foam or mixtures of multiple foams) and that the core contains no non-polymeric foam element that would materially affect the energy absorbent and force transmission of the core. In some embodiments, the core consists essentially of molded expanded polypropylene or expanded polyethylene.

As was noted above, the outer shell includes an elastomer, preferably elastomeric foam. In some embodiments, the elastomer is a polymer with a sufficient viscoelasticity such that, under normal use of the article of protective equipment into which the outer shell is incorporated, the outer shell will deform in the area of the shell which sustains and impact and will transmit a greater amount of the force of the impact to the area of the component of the protective equipment directly underneath the outer shell (at, or near, the point of impact) than would an outer shell made of a conventional rigid polymeric material (at least for some parts of the outer shell). Specific examples of elastomers suitable for use in the present invention are ethylene vinyl acetate foam and polyethylene foam.

In some embodiments, the outer shell consists essentially of an elastomer. In the present context, this should be understood to mean that all of the impact-sustaining elements of the outer shell are elastomeric (whether a single elastomer or mixtures of multiple elastomers) and that the outer shell contains no non-elastomeric element that would materially affect the flexing and force transmission of the outer shell. In some embodiments, the outer shell consists essentially of molded ethylene vinyl acetate foam or polyethylene foam.

In some embodiments, the article of protective equipment is generally free of non-deformable elements.

In some embodiments, the article of protective equipment is generally free of non-foam polymeric materials.

In some embodiments, the article of protective equipment is generally free of non-deformable polymeric materials.

In some embodiments, the article of protective equipment consists essentially of foam materials.

In some embodiments, the article of protective equipment consists essentially of expanded foam and elastomeric materials.

In some embodiments, the article of protective equipment consists of only one or more foams; stitching and/or adhesive; and, optionally, one or more fabrics and/or soft, flexible trims.

In some embodiments each of the elements of the article of protective equipment imparting structure to the article of protective equipment is deformable when the article of protective equipment is in use by the user.

In some embodiments, structural elements of polymeric materials of the article of protective equipment consist essentially of deformable polymeric materials.

In some embodiments, the protective equipment does not contain any structural elements having a durometer higher than about 70 (Shore A). For example, in some embodiments, all of the protective elements (e.g., shell(s), covering(s), and inner core(s)) have a durometer no higher than 70, 60, 50, 40, or no higher than 30 (Shore A). In certain embodiments, all of the protective elements have a durometer of about 30 to about 60 measured on the Shore A scale. For example, in certain specific embodiments, all of the protective elements have a durometer of about 35 to about 55 (Shore A).

In some embodiments, the article of protective equipment consists essentially of non-water-absorbent materials. By consisting essentially of non-water-absorbent materials, the protective equipment will not absorb water nor the sweat of the wearer, rending the protective equipment more conformable for longer periods of time, at least to some wearers.

In some embodiments, the core includes at least one reinforcement rib on the body-facing side thereof. Where included, such reinforcement ribs may be used for reinforcing the overall structure of the article of protective equipment, if such is required or desired. (The conventional rigid outer shell typically serves some structural function in conventional protective equipment articles. The absence of such a conventional rigid shell in embodiments of the present invention may mean that additional reinforcement may be required in some embodiments.) In some embodiments where at least one reinforcement rib is present, the at least one reinforcement rib may shaped to distribute a force of an impact around a joint of the user to be protected. Depending on the actual configuration of the equipment and particularly the reinforcement rib, it may be that it is the surface of the reinforcement rib that will actually contact the body of the wearer when the protective equipment sustains an impact. In such cases, the reinforcement rib may be structured so that the joint itself is not directly contacted by the surface the reinforcement rib during an impact. In some of such embodiments, the at least one reinforcement rib includes a circular portion encircling the joint. In some of such embodiments, the article of protective equipment further comprises a pad within the circular portion of the at least one reinforcement rib. The pad may be present to improve the comfort of the user and/or to provide additional protection to the user. Where present, the pad may be constructed of any suitable material serving its purpose. Examples include foams, gel packs, air packs, elastic materials, etc.

In some embodiments, the article of protective equipment further comprises an inner liner generally covering the body-facing side of the core. In some of such embodiments, the inner liner consists essentially of a deformable polymeric foam such as ethylene vinyl acetate or polyethylene foam. In some of such embodiments the inner liner consists essentially of ethylene vinyl acetate or polyethylene foam. In some of such embodiments, where present, the inner liner and the outer shell are directly secured together, encapsulating the core (i.e., the core is not directly secured to either the inner liner or the outer shell.) In other embodiments, the core is secured to the inner liner, the outer shell, or both. For example, the core can be secured to the inner liner, the outer shell, or both using an adhesive or stitching.

In some embodiments, the core is directly adjacent to the outer shell. In other embodiments, one or more deformable materials such as, for example, an additional foam layer may be positioned intermediate the core and outer shell.

In some embodiments the article of protective equipment is part of a protective garment. In some of such embodiments the garment is an upper-body protector and the article of protective equipment is a shoulder cap. In some of such embodiments the garment is an elbow protector and the article of protective equipment is an elbow cap. In some of such embodiments the garment is a shin guard and the article of protective equipment is a knee cap.

It should be understood that although generally described herein in terms of protective equipment for ice hockey, embodiments of protective equipment of the present invention can be used sports such as ice hockey, lacrosse, field hockey, football, baseball, softball, skateboarding, volleyball, skiing, snowboarding, BMX, inline skating, martial arts and other sports requiring shoulder, elbow, and/or knee protection. Also the embodiments of protective equipment of the present invention can have application in occupational safety e.g., construction, police, fire, etc.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF CERTAIN EMBODIMENTS

Figure 1:
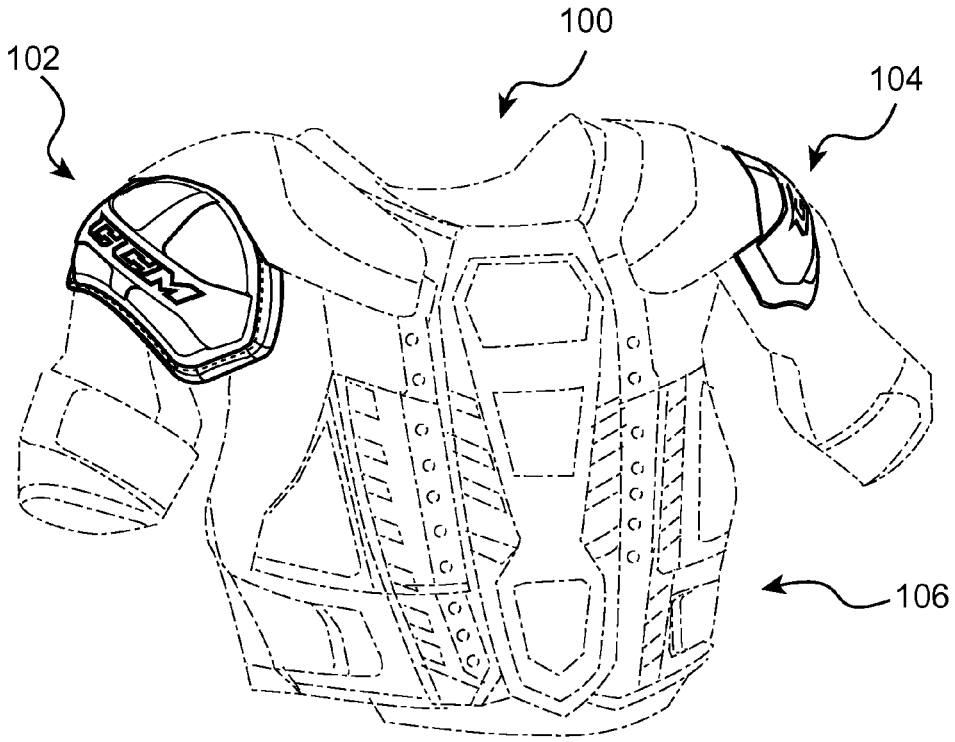
FIG. 1 is front right side perspective view of a protective garment (being an upper-body protector) having articles of protective equipment (being shoulder caps) being embodiments of the present invention.

Referring to FIG. 1, there is shown an upper-body protector 100 suitable for use by an appropriately sized athlete. The upper-body protector 100 includes two shoulder caps, a right shoulder cap 102 and a left shoulder cap 104. The shoulder caps 102 and 104 are attached to the main body 106 of the upper-body protector 100 so as to be capable of movement during game play with the movement of the arms of the player while still protecting the shoulders of the player. This attachment, as well as the remainder of the upper-body protector 100 are conventional and will not be described in further detail hereinbelow. A suitable example of such a conventional upper-body protector is the U+PRO™ upper body protector commercialized by CCM Hockey of Montreal, Canada. It should be understand that the shoulder caps 102 and 104 being incorporated into a protective garment as well as their means and method of attachment to the garment and their placement in the garment are merely exemplary and may vary from embodiment to embodiment. In some, embodiments, articles of protective equipment are individual articles and are not incorporated into protective garments at all.

Figure 2:
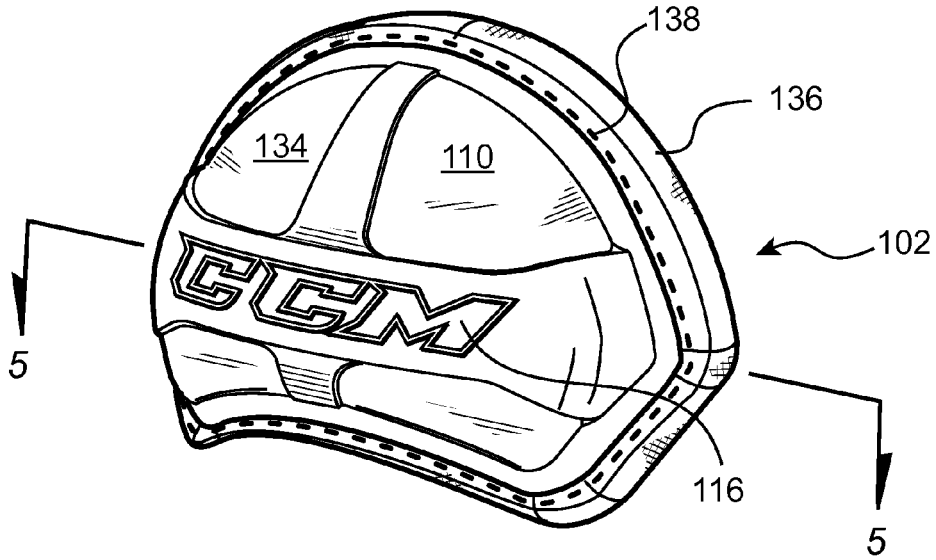
FIG. 2 is a front right side perspective view of the right shoulder cap of the upper-body protector shown in FIG. 1.

Referring to FIG. 2, there is shown the right shoulder cap 102 of the upper-body protector 100 of FIG. 1. The right shoulder cap 102 is shaped and dimensioned to provide protection to the right glenohumeral joint (colloquially the right "shoulder" joint) of the user of the upper body protector 100 from impacts when the upper body protector 100 is being correctly worn by an appropriately sized user. The shape of the right shoulder cap 102 is merely exemplary, other embodiments of the invention may have other shapes depending on, for example, design choice, the area of the body to be protected, the other elements of the protective garment, etc.

Figure 3:
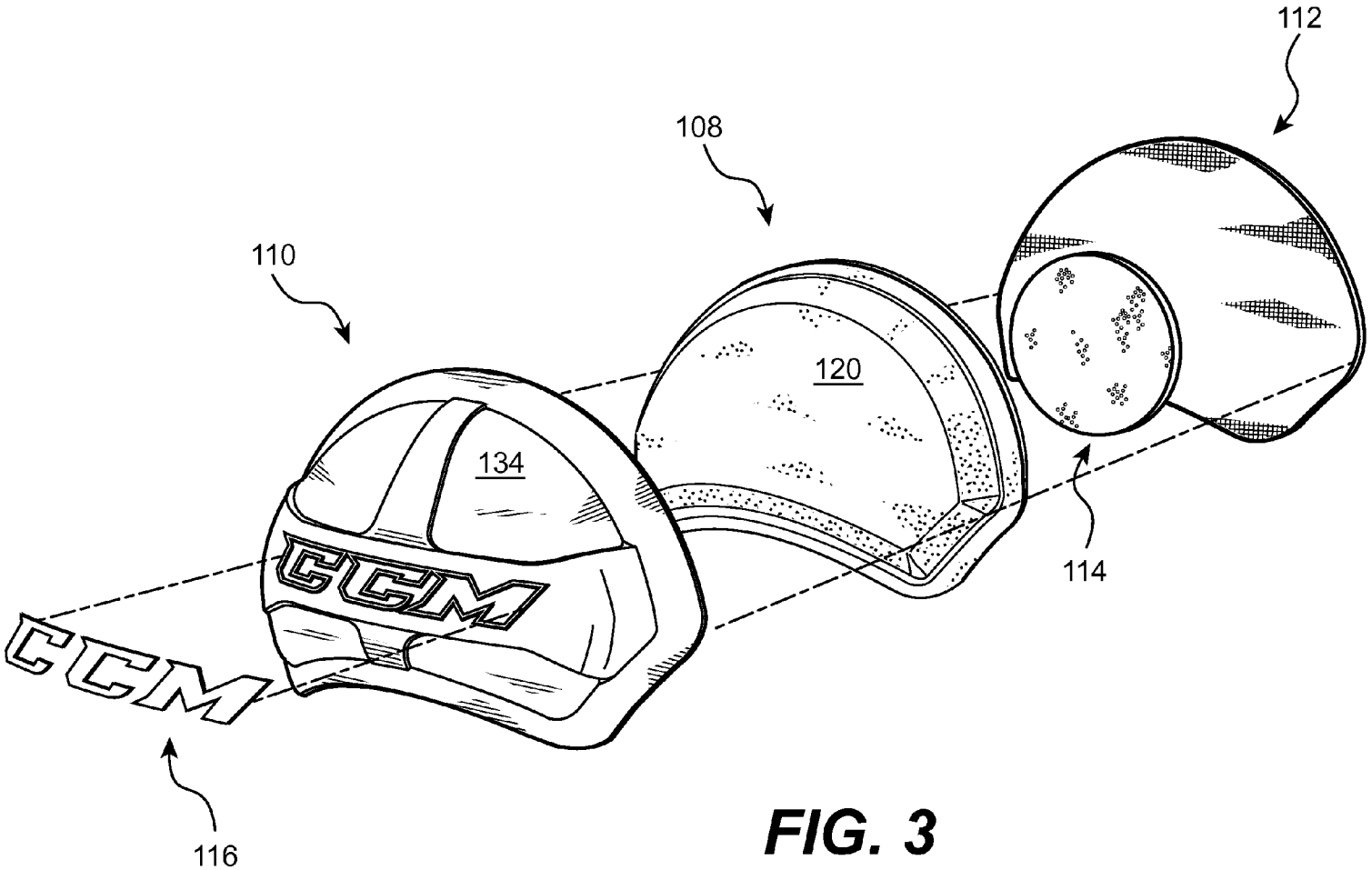
FIG. 3 is a front right side exploded view of the right shoulder cap shown in FIG. 2, showing the individual elements of which the shoulder cap is comprised.

Referring to FIG. 3, the right shoulder cap 102 of the upper-body protector is a composite structure comprised of an energy absorbent core 108, an outer shell 110, an inner liner 112, a pad 114 and a brand decal 116. (Other embodiments may have different components.)

Figure 4:
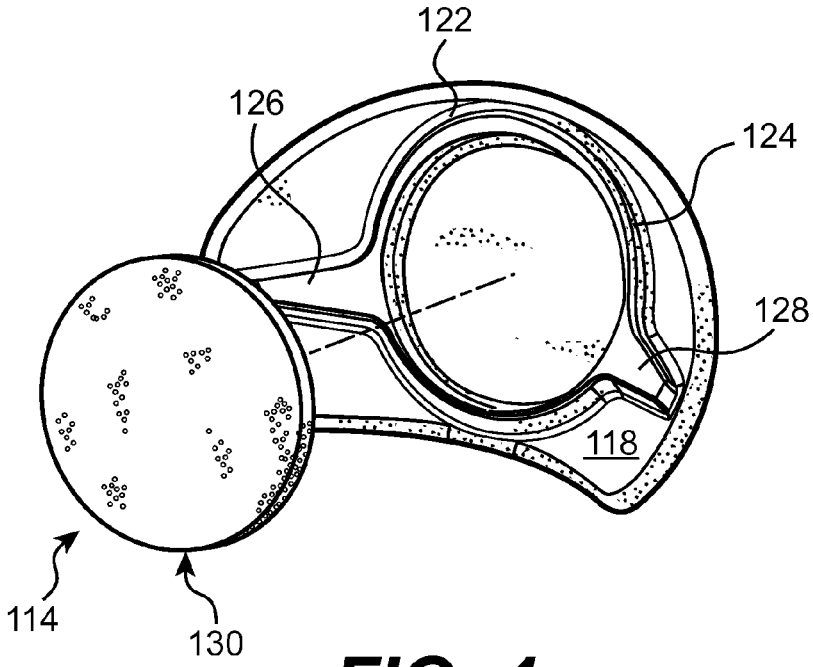
FIG. 4 is a left rear exploded view of the energy absorbent core and the pad of the right shoulder cap shown in FIG. 2.

The energy absorbent core 108 is a unitary structure made of molded expanded polypropylene, which is a polymeric foam. The energy absorbent core 108 has a body-facing side 118 (seen in FIG. 4) and a non-body-facing side (120). Referring to FIG. 4 the non-body-facing side 120 has a reinforcing rib 122 extending from the surface thereof. The reinforcing rib 122 has a circular section 124 with two extending wing sections 126, 128. The circular section 124 is sized and dimensioned size that the force of an impact will tend to be distributed around the right shoulder joint (as opposed to on the right shoulder joint). (The shape and location of the reinforcing rib 122 is merely exemplary, and will vary in other embodiments.)

Within the circular section 124 of the reinforcing rib 122 is a pad 114. The pad 114 is provided for adding comfort to the wearer of the upper-body protector 100. The pad 114 is a unitary structure made of an open-cell polymeric foam and is sized and dimensioned to be snugly retained with the circular section 124 via a friction fit between its exterior circumference and the circular section 124 of the reinforcing rib 122. (The construction of the pad 114 is merely exemplary and will vary in other embodiments.)

Figure 5:
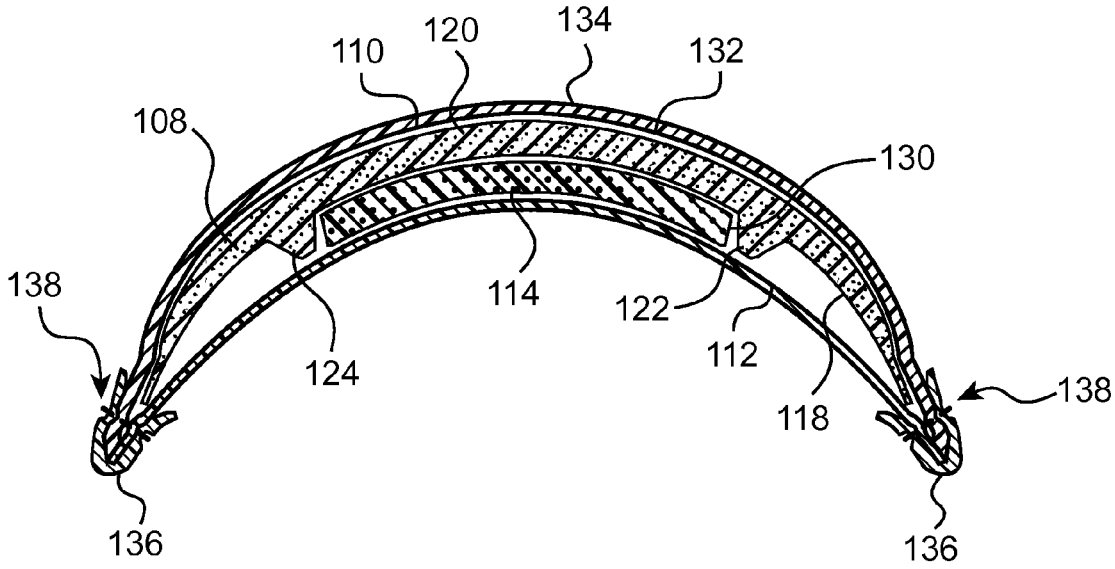
FIG. 5 is a cross-section of the right shoulder cap shown in FIG. 2, taken along the line 5-5 shown in FIG. 2.

Referring again to FIG. 2, the non-body facing side 120 of the energy absorbent core 108 is covered by outer shell 110. Outer shell 110 is sized and dimensioned so that the inner surface 132 (not shown in this view) fits snugly against the non-body-facing side 120 of the energy absorbent core 108 (this is best seen in FIG. 5). The outer surface 134 of the outer shell 110 is complimentary to inner surface 134 to provide a relatively smooth external shell to the shoulder cap 102. The outer shell 110 is a unitary structure made of molded ethylene vinyl acetate, an elastomer that is deformable under ordinary conditions of intended use of the shoulder cap 102.

Referring to FIG. 3, an inner liner 112 covers the body-facing side 118 of the absorbent core 108. The inner liner 112 is a unitary structure made of cross-linked polyethylene foam. Referring to FIG. 5, due to the construction of the shoulder cap 102 and the presence of the reinforcing rib 122, the inner liner 112 does not abut nor intimately conform to the body-facing side 118 of the absorbent core 108. It can be seen that the inner liner 112 is spaced from the body-facing side 118 of the core 108 both within the perimeter of the circular section 124 and around it. The inner liner 112 forms a generally smooth curved surface (see FIG. 5) of the interior of the shoulder cap 102. The inner liner 112 abuts the reinforcing rib 122 and the pad 130.

To form the right shoulder cap 102, each of the individual components (the absorbent core 108, the outer shell 110, the inner liner 112, and the pad 114) are separately manufactured (by conventional methods appropriate for the material of which the component(s) are constructed) and brought together in the appropriate alignment. As can been in FIG. 5, once the components have been aligned an appropriately sized and dimensioned piece of trim 136 is placed around the exterior edge and the trim, the outer shell 110 and the inner liner 112 are stitched together via stitching 138. The stitching 138 does not pass through the absorbent core 108; the absorbent core 108 is merely encapsulated by the outer shell 110 and the inner liner having been stitched together. (It should be understood that the stitching 138 is merely exemplary. In other embodiments the stitching may be varied and/or other methods of securing the various components of the shoulder cap 102 together may be employed.)

Once assembled the right shoulder cap 102 is used in the fabrication of the upper-body protector 100 in a conventional manner.

In this embodiment the left shoulder cap 104 is a mirror image of the right shoulder cap 102. In other embodiments the left shoulder cap need not be a mirror image of the right shoulder cap.

Figure 6:
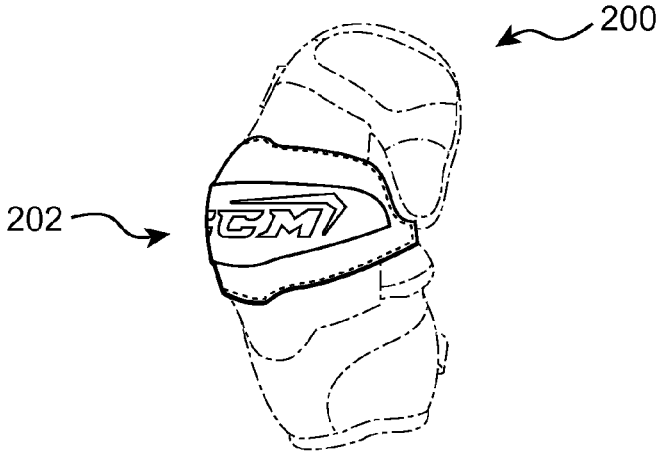
FIG. 6 is a front right side perspective view of a protective garment (being a right elbow protector) having a article of protective equipment (being an elbow cap) being another embodiment of the present invention.

Referring to FIG. 6, there is shown a right elbow protector 200 suitable for use by an appropriately sized athlete. The elbow protector 200 has an elbow cap 202. The construction and manufacture of the elbow cap 202 are similar to that of the shoulder cap 102 and will not be described in further detail with obvious exception that the elbow cap 202 is sized and dimensioned to protect the elbow of the user (as opposed to the shoulder). In all other aspects the right elbow protector 200 is conventional and will not be described in further detail. (A suitable example of such a conventional elbow protector is the U+ PRO™ elbow protector commercialized by CCM Hockey.) A left elbow protector could be, but not necessarily would be, a mirror image of the right elbow protector 200.

Figure 7:
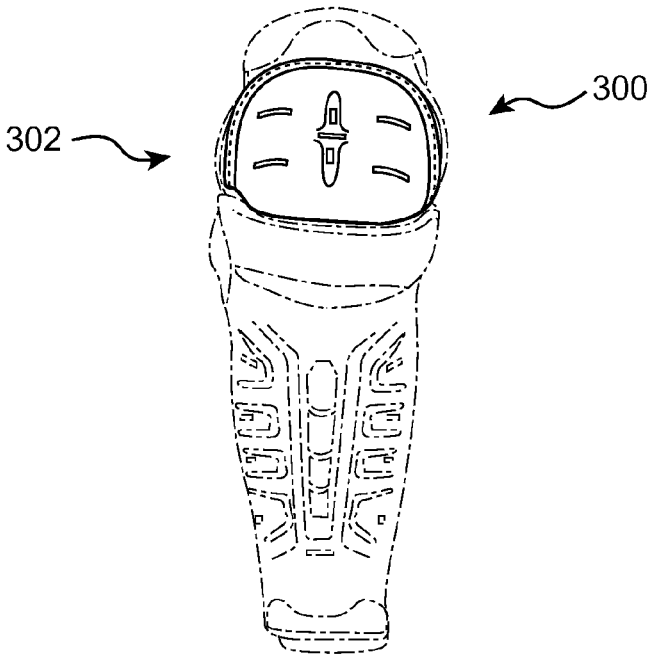
FIG. 7 is a front elevation view of a protective garment (being a right shin guard) having a article of protective equipment (being a knee cap) being another embodiment of the present invention.

Referring to FIG. 7, there is shown a right shin guard 300 suitable for use by an appropriately sized athlete. The shin guard 300 has a knee cap 302. The construction and manufacture of the knee cap 302 are similar to that of the shoulder cap 102 and will not be described in further detail with obvious exception that the knee cap 302 is sized and dimensioned to protect the knee of the user (as opposed to the shoulder). In all other aspects the right shin guard 300 is conventional and will not be described in further detail. (A suitable example of such a conventional shin guard is the U+PRO™ shin guard commercialized by CCM Hockey.) A left shin guard could be, but not necessarily would be, a mirror image of the right shin guard 300.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A user wearable article of protective equipment for protecting a portion of a body of the user, the article of protective equipment generally conforming to the portion of the body of the user to be protected when worn by the user, the article of protective equipment comprising:

an energy absorbent core, the core having a body-facing side and an opposing non-body-facing side, the core comprising a polymeric foam, the core including at least one reinforcement rib extending from the body-facing side thereof and defining a perimeter;

a foam pad received against the body-facing side of the core within the perimeter and bordered by the at least one reinforcement rib;

an outer shell generally covering the non-body-facing side of the core, the outer shell being deformable during the use of the article of protective equipment by the user; and an inner liner connected to the outer shell and encapsulating the core and foam pad, the inner liner being spaced from the body-facing side of the core within and around the perimeter defined by the at least one rib.

2. The article of protective equipment of claim 1, wherein the core consists essentially of the polymeric foam.

3. The article of protective equipment of claim 1, wherein the outer shell consists essentially of an elastomer.

4. The article of protective equipment of claim 1, wherein the article of protective equipment is generally free of non-deformable elements.

5. The article of protective equipment of claim 1, wherein the article of protective equipment is generally free of non-foam polymeric materials.

6. The article of protective equipment of claim 1, wherein the article of protective equipment is generally free of non-deformable polymeric materials.

7. The article of protective equipment of claim 1, wherein the article of protective equipment consists essentially of foam materials.

8. The article of protective equipment of claim 1, wherein each of the elements of the article of protective equipment imparting structure to the article of protective equipment is deformable when the article of protective equipment is in use by the user.

9. The article of protective equipment of claim 1, wherein structural elements of polymeric materials of the article of protective equipment consist essentially of deformable polymeric materials.

10. The article of protective equipment of claim 1, wherein the article of protective equipment consists essentially of non-water-absorbent materials.

11. The article of protective equipment of claim 1, wherein the pad is retained within the perimeter of the at least one reinforcement rib by a friction fit between the pad and the at least one reinforcement rib.

12. The article of protective equipment of claim 1, wherein the portion of the body of the user to be protected includes a joint, and the at least one reinforcement rib is shaped to distribute a force of an impact around the joint.

13. The article of protective equipment of claim 12, wherein the perimeter of the at least one reinforcement rib includes a circular portion encircling the joint.

14. The article of protective equipment of claim 1, wherein the core consists essentially of molded expanded polypropylene.

15. The article of protective equipment of claim 1, wherein the outer shell consists essentially of molded ethylene vinyl acetate.

16. The article of protective equipment of claim 1, wherein the inner liner generally consists essentially of a deformable polymeric foam.

17. The article of protective equipment of claim 1, wherein the article of protective equipment is part of a protective garment.

18. The article of protective equipment of claim 17, wherein the garment is one of an upper-body protector, a shin protector, and an elbow protector; and the article of protective equipment is respectively one of a shoulder cap, a knee cap, and an elbow cap.

19. An article of protective equipment, comprising:

an expanded polymer foam core, the core having a body-facing side and an opposing non-body-facing side, the core including at least one reinforcement rib extending from the body-facing side thereof and defining a perimeter;

a pad received against the body-facing side of the core within the perimeter and bordered by the at least one reinforcement rib;

an elastomeric outer shell generally covering the non-body-facing side of the core; and an inner liner connected to the outer shell and encapsulating the core and pad, the inner liner being spaced from the body-facing side of the core within and around the perimeter defined by the at least one rib.

20. The article of protective equipment of claim 19, wherein the article of protective equipment is one of a shoulder cap, a knee cap, and an elbow cap.

21. The article of protective equipment of claim 19, wherein the article of protective equipment is a shoulder cap.

22. The article of protective equipment of claim 1, wherein the foam pad is a unitary structure made of an open-cell polymeric foam.

23. The article of protective equipment of claim 19, wherein the pad is a unitary structure made of an open-cell polymeric foam.

* * * * *